United States Patent [19]

Nagamoto et al.

[11] 4,145,047

[45] Mar. 20, 1979

[54] RACKET

[75] Inventors: Itsushi Nagamoto; Masaharu Kuwabara; Kunimasa Muroi, all of Hamamatsu, Japan

[73] Assignee: Nippon Gakki Seizo Kabushiki Kaisha, Hamamatsu, Japan

[21] Appl. No.: 799,183

[22] Filed: May 23, 1977

[30] Foreign Application Priority Data

May 27, 1976 [JP] Japan ..... 51/61632

[51] Int. Cl.[2] ..... A63B 49/10

[52] U.S. Cl. ..... 273/73 F; 273/73 G

[58] Field of Search ..... 273/73 R, 73 C, 73 F, 273/73 G, 73 H, DIG. 7, DIG. 23

[56] References Cited

U.S. PATENT DOCUMENTS

| | | | |
|---|---|---|---|
| 2,153,550 | 4/1939 | Cowdery | 273/80 B |
| 2,171,223 | 8/1939 | Robinson | 273/73 H |
| 2,183,925 | 12/1939 | Simpson | 273/73 G X |
| 2,395,864 | 3/1946 | Geerlings et al. | 273/73 C X |
| 3,647,211 | 3/1972 | Doessel et al. | 273/73 C |
| 3,787,051 | 1/1974 | Johns | 273/73 F |
| 3,889,951 | 6/1975 | Schaefer et al. | 273/73 F |
| 3,941,380 | 3/1976 | Lacoste | 273/73 R X |

FOREIGN PATENT DOCUMENTS

| | | | |
|---|---|---|---|
| 101432 | 6/1937 | Australia | 273/73 G |
| 886136 | 6/1943 | France | 273/73 G |
| 220103 of | 1924 | United Kingdom | 273/73 G |
| 482164 | 3/1938 | United Kingdom | 273/73 H |
| 1322606 | 7/1973 | United Kingdom | 273/73 H |

*Primary Examiner*—Richard J. Apley

*Attorney, Agent, or Firm*—Lerner, David, Littenberg & Samuel

[57] ABSTRACT

In a frame of a fiber reinforced plastic tennis racket made by molding process, thickness of the racket frame is reduced in an area starting from the throat to grip portion, and more preferably in the throat portion, to mitigate the bending stiffness of the frame at the portion thereby effectively hindering direct transmission of impact on the playing face to players' hands.

10 Claims, 4 Drawing Figures

RACKET

BACKGROUND OF THE INVENTION

The present invention relates to an improved racket, and more particularly relates to an improved construction of a fiber reinforced plastic tennis racket made by molding process.

In the general construction of the conventional fiber reinforced plastic tennis racket, the frame takes the form of an elongated integral one piece body and the shaft portion thereof includes a foamed resin core wholly covered by a glass fiber reinforced plastic envelope. The fiber reinforced plastic envelope has a multiply configuration made of a plurality of fiber layers impregnated with plastic resin and, in general, this multiply configuration is substantially homogeneous along the entire length of the frame. In other words, the transverse cross sectional profiles of the conventional fiber reinforced plastic tennis racket are substantially similar to each other in the head portion, in the throat portions and in the shaft portion. From the view point of vibration system, this kind of uniform internal construction of the frame is well suited for smooth transmission of elastic vibration waves.

Thus, with the above-described internal construction of the conventional tennis racket, vibrations generated by impact on strings when hitting balls are transmitted quite smoothly and directly to players' hands via the throat and shaft portions of the racket and give the players the so-called "hard touch" at hitting balls. Such direct transmission often gives serious damage to the players hands, also. In addition, the above-described hard touch at hitting balls often tend to slow player's sharp perception in hitting balls.

SUMMARY OF THE INVENTION

It is the primary object of the present invention to provide a tennis racket able to mitigate direct transmission of impact on the playing face to players' hand.

It is another object of the present invention to provide a tennis racket affording soft touch at hitting balls to players.

It is the other object of the present invention to provide a tennis racket which assures intact player's sharp perception in hitting balls.

It is the other object of the present invention to provide a tennis racket which effectively prevents, or at least reduces, damages on the players' hands at hitting balls.

In accordance with the present invention, the thickness of the frame is reduced in an area starting from the throat to grip portion, and more preferably in the throat portion, thereby effectively hindering direct transmission of impact on the playing face to players' hands. For most effective hindrance of the transmission, the thickness should preferably reduced in the direction perpendicular to the plane including the playing face of the racket. Incorporation of graphite and/or boron fibers in the internal multiply configuration of the frame in the handle portion near the reduced thickness portion assures further enhanced hindrance of the transmission.

DESCRIPTION OF THE PREFERRED EMBODIMENT

Figure 1:
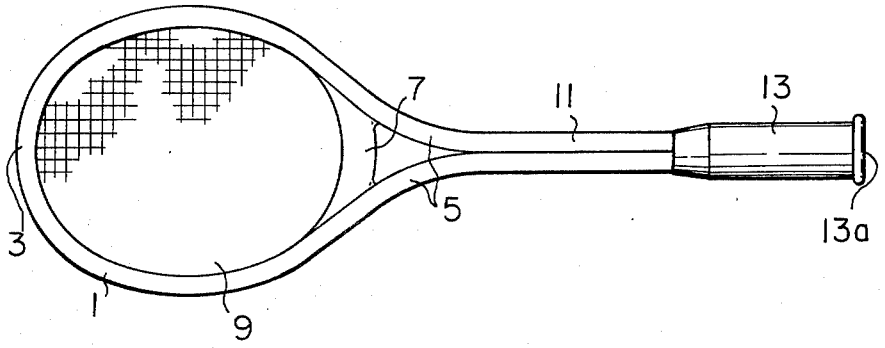
FIG. 1 is a top view of a tennis racket to which the present invention is applied.

FIG. 1 generally depicts a tennis racket of popular type and construction which is made of a glass fiber reinforced plastics in accordance with one aspect of the present invention. The racket comprises a frame 1 having an approximately oval-shaped or ovaloid head portion 3 terminating in a pair of closely spaced sloping extensions forming a throat portin 5 of the racket. A separate throat piece or yoke 7 is disposed to the inner side of the sloping frame extensions at the throat portion 5. The oval-shaped portion of the frame 1 and the yoke 7 define a stringing area or playing face 9 of the racket which is comprised of main or long strings and cross or short strings. The sloping extensions are coupled side by side with each other to form a handle or shaft portion 11 of the racket, the end of which is encased by a grip portion 13.

Figure 3:
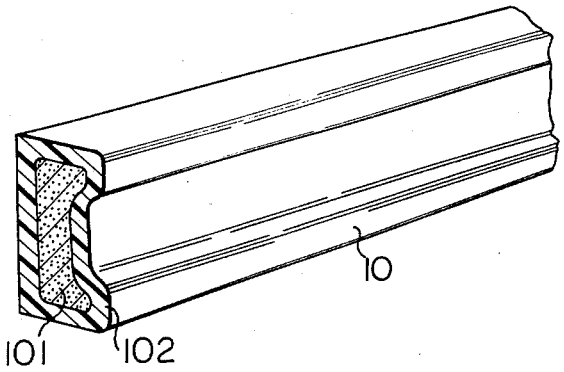
FIG. 3 depicts the general transverse cross sectional configuration of a material rod to be shaped into the tennis racket, and FIG. 4 depict formation of the reduced thickness portion during molding process in accordance with the present invention.

The racket frame 1 is made of glass fiber reinforced plastics by molding process. In the manufacturing thereof, an elongated straight rod 10 such as shown in FIG. 3 is prepared, which is comprised of a core 101 generally made of a foamed resin such as urethane foam. This core 101 is wholly covered by a prepreg envelope 102 made of numerous multiply fiber layers preimpregnated with thermosetting resin. This straight material rod 101 is curved and placed in position between cooperating molds and hardened into the end product by application of heat under pressure. Thus, the multiply configuration of the envelope 102 and the transverse cross sectional profile of the frame 1 are substantially uniform over the entire length of the frame 1.

The present invention should, for example, be applied to the throat portion 5 of the frame 1. That is, in accordance with the present invention, the thickness of the throat portion 5 of the frame 1, i.e. the size of the frame 1 perpendicular to the plane including the playing face 9, is reduced from those of the remaining portions of the frame 1.

Figure 2:
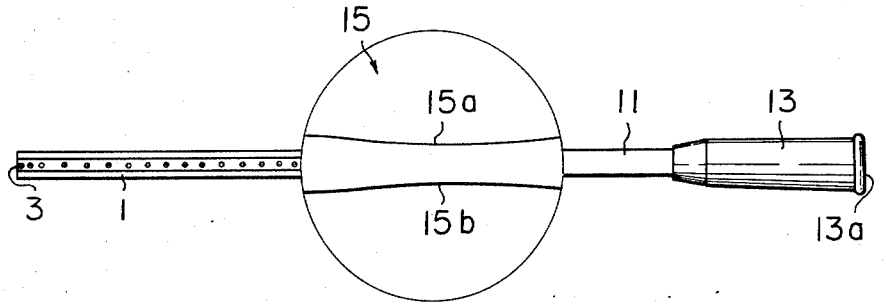
FIG. 2 is a side view, partly enlarged, of the tennis racket shown in FIG. 1.

In the case of the embodiment shown in FIG. 2, this reduced thickness portion 15 is given by shallow hollows **15*a*, 15*b* formed in the surfaces of the throat portion 5 which are substantially parallel to the plane including the playing face 9**.

The hollows **15*a* may take the form of either spots or somewhat elongated grooves extending in the longitudinal direction of the frame 1. It is preferable that the hollows 15*a*, 15*b* extend almost over the entire width of the frame 1**.

In the case of the embodiment shown in FIG. 2, the reduced thickness portion 15 is given by hollows **15*a*, 15*b* formed in both surfaces of the frame 1. Whereas, it is employable also that a hollow or hollows 15*a* formed in one surface of the frame 1 may afford the reduced thickness portion 15**.

In a further preferred embodiment of the present invention, in combination with the presence of the reduced thickness portion 15, content of the fibers in the prepreg envelope 102 may be increased in the handle or shaft portion 11 between the reduced thickness portion 15 and the butt end **13*a* of the grip portion 13. It is also employable to incorporate not only glass fibers but such fibers as graphite and boron fibers in the multiply configuration of the envelope 102 in the handle or shaft portion between the reduced thickness portion 15 and the butt end 13***a* of the grip portion 13.

Figure 4:
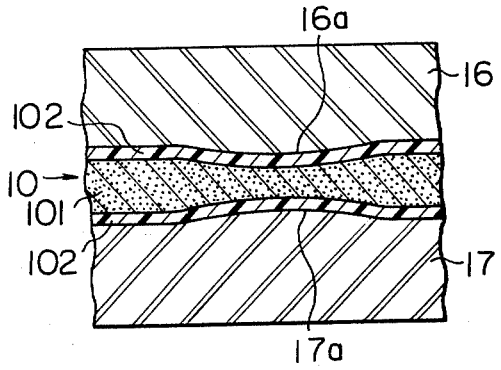

As already described, the tennis racket in accordance with the present invention is manufactured by molding. In order to provide the surface hollows 15*a*, 15*b* such as the ones shown in FIG. 2, an upper mold 16 and a lower mold 17 shown in FIG. 4 are provided with bulges 16*a* and 17*a* at a position corresponding to the throat portion 5 of the racket to be obtained. As the material rod 10 shown in FIG. 3 is set in the molds 16 and 17 in an incompletely hardened state, presence of such bulges 16*a* and 17*a* on the molds naturally develops corresponding hollows 15*a* in the surfaces of the frame 1.

Disposition of the hollows is not limited to the surface or surfaces running substantially parallel to the plane including the playing face 9 as is the case with the embodiment shown in FIG. 2. It or they may be formed in a surface or surfaces which are perpendicular to the plane including the playing face 9. However, in consideration of the fact that transmission of the elastic vibrations caused by hitting balls is prevailing in planes of the frame 1 parallel to the plane including the playing face, it is most advantageous to form the hollow or hollows 15 in the surface or surfaces of the frame 1 parallel to the plane including the playing face 9 in order to most effectively mitigate the transmission of the elastic vibrations.

Likewise, disposition of the reduced thickness portion 15 is not limited to the throat portion 5 of the frame 1. It may be formed in the area of the frame 1 extending from the throat portion to the starting position of the grip portion 13.

In a practical example of the present invention, the minimum thickness of the reduced thickness portion is about 17mm. when the average thickness of the remaining portions of the frame 1 is about 22 mm.

Minimization of the transverse cross sectional profile at the reduced thickness portion connects to corresponding reduction in the geometrical moment of inertia (or second moment of area) in the thickness direction and this reduced geometrical moment of inertia results in correspondingly minimized bending stiffness at the reduced thickness portion, thereby making the frame 1 flexible at the portion. In addition, presence of the hollow or hollows in the surface provides a kind of bulge or bulges into the internal configuration of the frame and this bulge effectively disperses the elastic vibration waves during the transmission. Thus, the impact on the players' hands can well be damped to prevent or at least reduce damage on the players' hands. In addition, stress concentration upon the joint of the yoke to the frame can be remarkably mitigated, thereby affording soft touch in hitting balls just like wooden tennis rackets.

Further, in manufacturing the tennis racket by molding in accordance with the present invention, the material rod is pressed between the pair of molds as shown in FIG. 4. During this molding under pressure, the multiply configuration of the prepreg envelope 102 is more or less compressed in the reduced thickness portion 15. Due to this compression, the content of the resin in the reduced thickness portion somewhat reduces whereas most of fibers in the multiply configuration extend longitudinally of the frame 1 across the reduced thickness portion 15 to effectively bridge the intact thickness portions on both longitudinal sides of the reduced thickness portion 15. This bridge effect by the fibers effectively prevents or at least minimizes breakout of the fiber reinforced plastic material and/or destruction of the multiply configuration at portions adjacent to the reduced thickness portion which otherwise occur when the elastic vibration waves pass there through.

The above-described incorporation of the reinforcing fibers such as glass, graphite and boron fibers in the multiply configuration in accordance with the preferred embodiment of the present invention provides some shift in the homogeneous continuity of the multiply configuration along the frame length. Presence of such a heterogeneous spot or area in the travelling course of the elastic vibration waves causes phase difference between the elastic vibration waves and this phase difference causes interference between the waves which leads to damping of the waves. It should also be noted that the nodes of the elastic vibration waves can be displaced from the throat portion by properly selecting the dimension and location of the reduced thickness portion, thereby further mitigating the impact on the players' hands.

What is claimed is:

1. An improved racket frame having a head portion defining a playing face, a throat portion, a shaft portion, and a gripping portion, comprising:

said frame including an inner core and an outer envelope encasing said inner core, said outer envelope being formed of a fiber reinforced plastic structure, said frame in the region of at least said throat portion having a reduced thickness portion including said inner core having a bulge extending into said inner core, said reduced thickness portion being reduced at least in a direction substantially perpendicular to the plane including said playing face, said reduced thickness portion being located along the path of travel of vibration waves transmitted from said playing face to said gripping portion which are generated upon impact of said playing face, said reduced thickness portion being operable to change the phase relationship of at least a portion of said transmitted vibration waves to cause wave interference therebetween for dampening said vibration waves as they traverse said path of travel to said gripping portion.

2. An improved racket frame in accordance with claim 1, wherein said reduced thickness portion is also reduced in a direction substantially parallel to the plane including said playing face.

3. An improved racket frame in accordance with claim 1, wherein said throat portion, said shaft portion, and said gripping portion have said reduced thickness portions.

4. An improved racket frame in accordance with claim 1, wherein said inner core is formed of foamed resin.

5. An improved racket frame in accordance with claim 1, wherein said outer envelope is formed of a glass fiber reinforced plastic multi-ply structure.

6. An improved racket frame having a head portion defining a playing face, a throat portion, a shaft portion, and a gripping portion, comprising:

said frame including an inner core and an outer envelope encasing said inner core, said outer envelope being formed of a fiber reinforced plastic structure, said frame in the region of at least said throat portion having a reduced thickness portion, including said inner core having a bulge extending into said inner core, said reduced thickness portion in the region of said throat portion including additional reinforcing fibers in said outer envelope to define a heterogeneous area, said heterogeneous area in said reduced thickness portion being located along the path of travel of vibration waves transmitted from said playing face to said gripping portion which are generated upon impact of said playing face, said heterogeneous area being operable to change the phase relationship of at least a portion of said transmitted waves to cause wave interference therebetween for dampening said vibration waves as they traverse said path of travel to said gripping portion.

7. An improved racket frame in accordance with claim 6, wherein said additional fibers extend longitudinally of the frame across said reduced thickness portion to connect the adjacent non-reduced thickness portions with said reduced thickness portion to strengthen said racket frame.

8. An improved racket frame in accordance with claim 6, wherein said inner core is formed of foamed resin.

9. An improved racket frame in accordance with claim 6, wherein said outer envelope is formed of a glass fiber reinforced plastic multi-ply structure.

10. An improved racket frame in accordance with claim 6, wherein said additional reinforcing fibers in said outer envelope are of a type different from said first-mentioned fibers to define a heterogeneous area of said different fibers.

* * * * *